US006484427B1

(12) United States Patent
Santa Cruz et al.

(10) Patent No.: US 6,484,427 B1
(45) Date of Patent: Nov. 26, 2002

(54) TAILGATE SIGN

(76) Inventors: Cathy D. Santa Cruz, 7630 Tholl Dr., Reno, NV (US) 89506; Terry W. Tiernay, 3555 Crazy Horse Rd., Reno, NV (US) 89510

( * ) Notice: Subject to any disclaimer, the term of this patent is extended or adjusted under 35 U.S.C. 154(b) by 0 days.

(21) Appl. No.: 09/359,160

(22) Filed: Jul. 21, 1999

(51) Int. Cl.[7] ..... G09F 21/04
(52) U.S. Cl. ..... 40/591; 296/21; 40/643
(58) Field of Search ..... 40/643, 644, 591, 40/586; 224/277; 296/21; 206/335; 160/327, 328, 329

(56) References Cited

U.S. PATENT DOCUMENTS 3,214,852 A * 11/1965 Ford et al. ..... 40/586 X
4,091,766 A * 5/1978 Colliard ..... 40/586 X
5,170,917 A * 12/1992 Tourigny ..... 40/586 X
5,255,464 A * 10/1993 Marecek ..... 40/591
5,477,633 A * 12/1995 Leinberger ..... 40/644 X
5,632,044 A * 5/1997 Sloot ..... 40/586 X
5,704,067 A * 1/1998 Brady ..... 40/586 X
5,850,957 A * 12/1998 Morris ..... 40/591 X
6,006,462 A * 12/1999 Lackomar ..... 40/643 X

* cited by examiner

*Primary Examiner*—B. Dayoan
*Assistant Examiner*—William L. Miller

(57) ABSTRACT

A tailgate sign which is removably attachable onto a pre-existing tailgate and is used for display of signs thereon, or the like. Also, in one embodiment the sign may be reversible or rotated between a first display position and a second display position, etc.

8 Claims, 3 Drawing Sheets

TAILGATE SIGN

FIELD OF THE INVENTION

This invention relates to advertising signs that are used in combination with a vehicle tailgate, such signs as sports team insignia's, personal statements, large bumper stickers, i.e., but more particularly relates to an advertising sign that is substantially in the form of a integral sleeve which is removably attachable to the tailgate, such as by loop and pile fasteners. Also if so desired, the sleeve may include indicia on two sides so as to be reversible. Or the sleeve may also include a pocket for containment of business cards, flyers, or the like. Or still further the sleeve may include a weather-proof transparent compartment for containing and displaying a sign of user choice.

BACKGROUND OF THE INVENTION

In the past, vehicles have been commonly used for either business purposes or family and recreational use. Because of the need to identify a business by its name or its services or products, company-owned vehicles are typically permanently marked with the company's name, logo, slogans or the like. While in some instances marking vehicles would not be desired, the vehicle owner may still wish to convey a message to passersby. The cost of placing permanent markings on vehicles can be expensive and may mar the surface of the vehicle. Adhesive backed signs can similarly cause the paint of the vehicle surface to degrade or peel away. Magnetic signs may scratch the vehicle's paint, since moisture and dirt accumulation on the vehicle surface can cause the magnets to slip along the vehicle body surface. Similarly, the irregular surfaces common to tailgates cause a magnet to seal incompletely, creating the possibility of a sign dislodging or breaking completely away from the tailgate surface.

Attempts have been made in the past to overcome the difficulties previously associated with removable prior art signs, but each have inherent disadvantages which the present invention addresses and overcomes in a manner heretofore not taught. For example, U.S. Pat. Nos. 1,833,474 entitled COVER FOR AUTOMOBILE DOORS, to Robinson, and 2,166,048 entitled ADVERTISING SIGN FOR VEHICLES, to Fritsch, are each functional for their intended purpose but neither would be suitable for use on a tailgate of a vehicle as is the present invention.

Another example is taught in U.S. Pat. No. 5,255,464 entitled TAILGATE SIGN to Marecek which is the closest reference the applicants could find. Wherein the sign is attachable to a tailgate, but it is complicated and uses multiple attachment means for attaching the sign to the tailgate, which the present invention eliminates. Also, the present invention includes various embodiments which provide unique characteristics, not taught within the noted reference. Such as, the present invention if desired may include signs on two sides, which allows the sleeve to be reversible. Or if preferred, signs may be inserted interchangeably into transparent compartments for display of the signs there through.

SUMMARY OF THE INVENTION

It is therefore an object of the present invention to provide a tailgate sign which is removably adjustably attachable to a pre-existing tailgate.

Another object of the present invention is to provide a tailgate sign which is substantially a retrofit and will fit substantially any type or size of vehicle tailgate.

Yet another object of the present invention is to provide a tailgate sign that may be reversible.

Still another object of the present invention is to provide a tailgate sign that includes transparent compartments for containment of signs. This allows a user to purchase the tailgate sign and then put in a sign of their choice, without the need to buy a new sleeve. Unlike the prior art wherein indicia or a sign is permanently imprinted within the material which forms the tailgate sign.

It is another object of the present invention to provide a tailgate sign which may include an optional pocket for containment of business cards, flyers, or the like.

Also a further object of the present invention is to provide a tailgate sign which is economical to manufacture and use.

A further object of the present invention is to provide a tailgate sign that is used to display not only advertisements for businesses, but may also be used for advertising a message or a slogan, such as "JUST MARRIED", "Denver Bronco's World Championship" etc.

A very important object of the present invention is to provide a tailgate sign which when attached to the tailgate will not mar or damage the vehicle surface in any manner, it complies with Highway Patrol Regulations, and it reduces the chance for accidental disengagement of the sign while driving.

Yet another object of the present invention is to provide a tailgate sign which allows the tailgate to be fully functional even when the present invention is installed.

Also another object of the present invention is to provide a tailgate sign which allows a user to grasp the tailgate handle, but will not aesthetically interfere with viewing of the sign, which is an inherent disadvantage within the prior art.

Other objects and advantages will be seen when taken into consideration with the following drawings and specification.

DETAILED DESCRIPTION OF THE DRAWINGS

Figure 1:
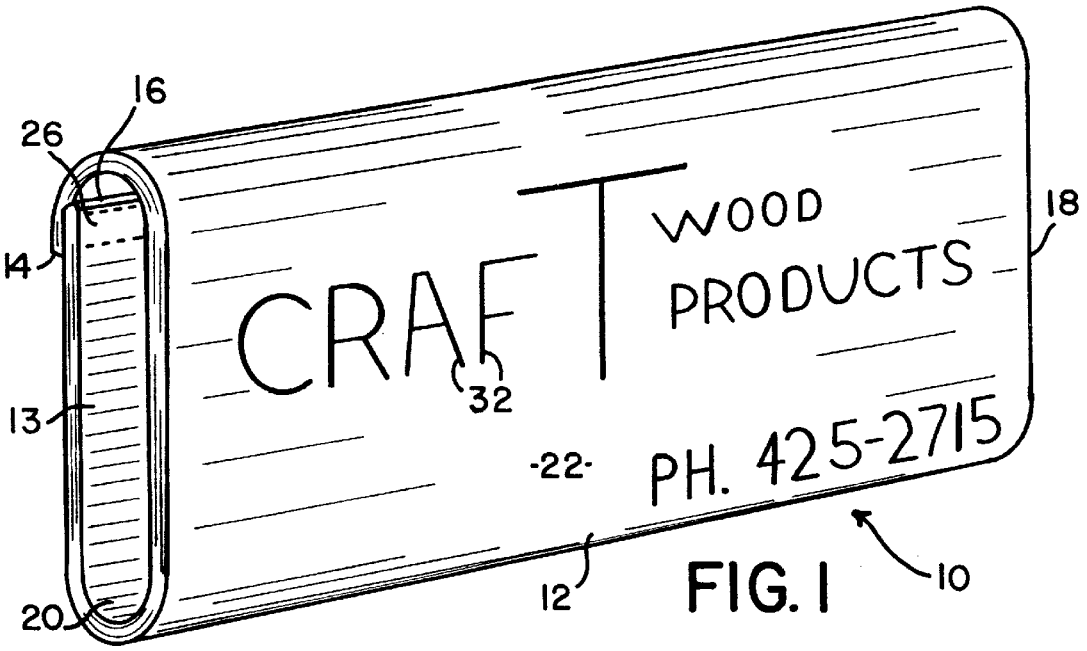
FIG. 1 is substantially a perspective overview of the preferred embodiment for the present invention.

Referring now to the drawings wherein like characters refer to like elements throughout the various views. In FIGS. 1–6, (arrow 10) represents an overview for the present invention which is a tailgate sign and is substantially formed from an integrally formed sleeve (12). With sleeve (12) providing an internal hollow cavity (13) which is of a shape and size to slidably receive a vehicles tailgate therein (not shown), and sleeve (12) is used for display of a sign, or the like according to user choice. It is to be understood sleeve (12) can be made of any suitable shape or size of engineering choice which allows sleeve (12) to be a retrofit, so as to fit substantially any tailgate of user choice. Furthermore, sleeve (12) can be made from any suitable material of engineering choice, such as NYLON, SPANDEX, limber plastic, cotton, etc.

Figure 2:
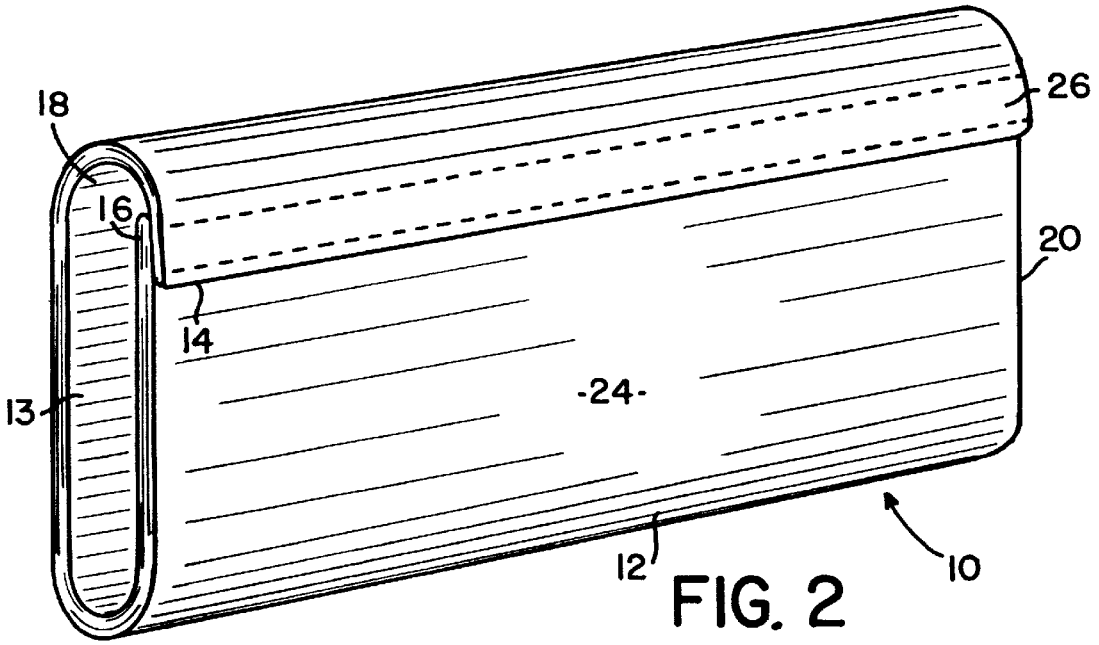
FIG. 2 is substantially a perspective view showing the embodiment when in a second reversed position.

Referring now to FIGS. 1 & 2 which substantially illustrate the preferred embodiment for the present invention. Wherein sleeve (12) is rectangular and integrally formed having a first end (14), a second end (16), a right side open end (18), a left side open end (20), a front-side (22), and a back-side (24).

Sleeve (12) further includes attachment means for attaching the first end (14) to the second end (16). The attachment means holds the first and second ends in overlapping relationship when the tailgate sign is in place covering the truck tailgate. It is to be understood that any suitable attachment means of engineering choice may be used, such as snaps, buttons, glue, etc. Or as illustrated in FIGS. 1 & 2, we show the attachment means for attaching the first end (14) to the second end (16) is by the first end (14) and the second end (16) being adjustably held together with at least one loop and pile fastener, such as VELCRO (26), or the like.

Figure 3:
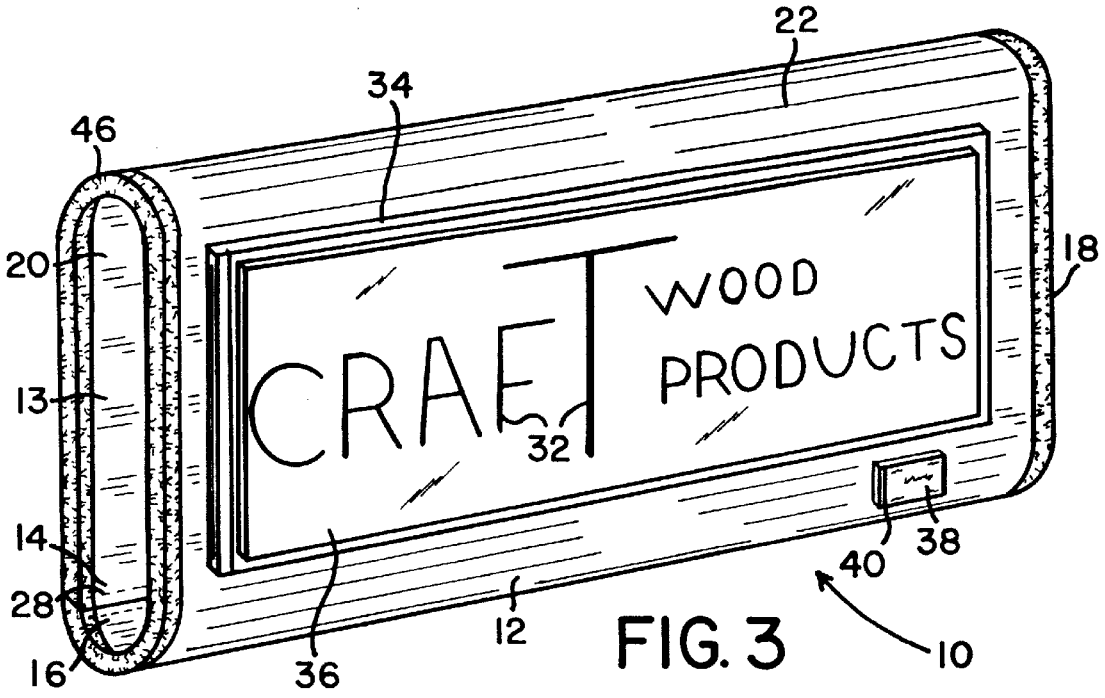
FIG. 3 is substantially a perspective view showing the embodiment with some structural variations.
Figure 4:
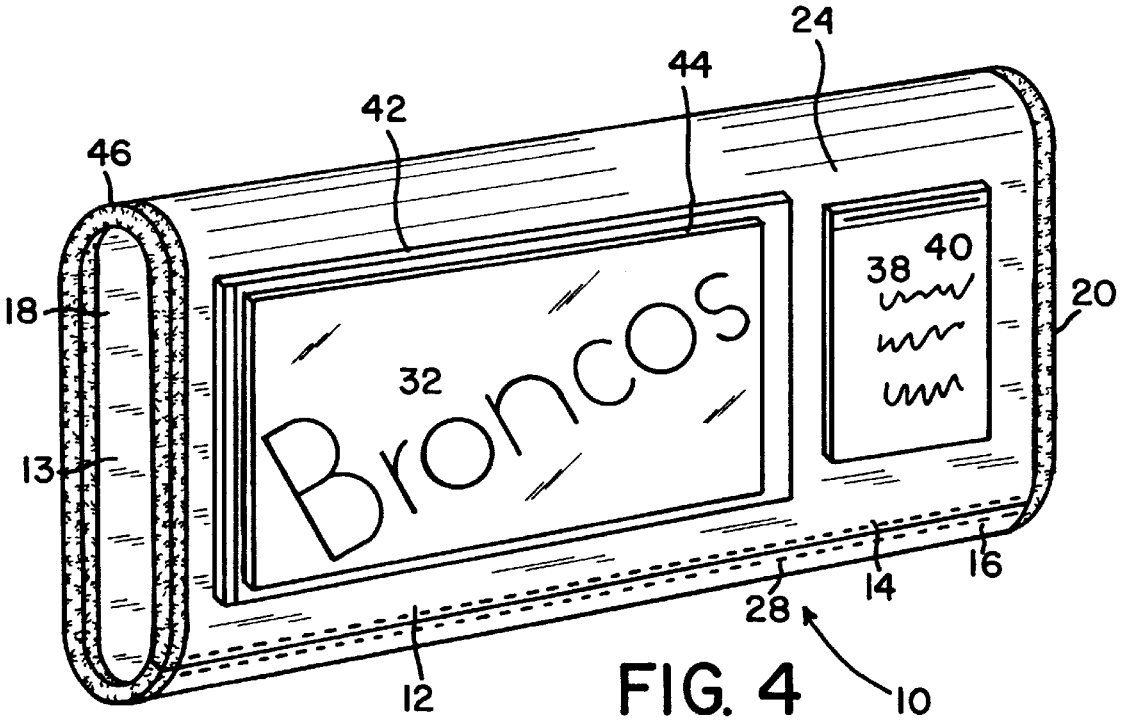
FIG. 4 is substantially a perspective view showing the embodiment above when in a second reversed position.
Figure 5:
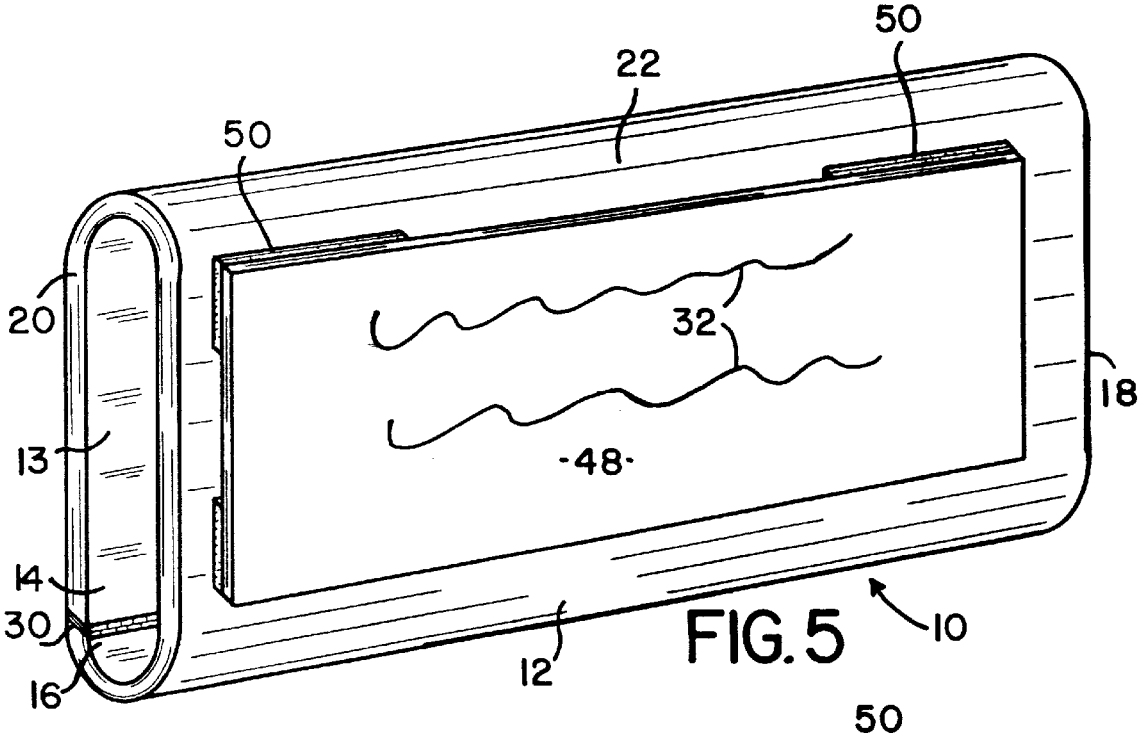
FIG. 5 is substantially a perspective view showing the embodiment with further structural variations.
Figure 6:
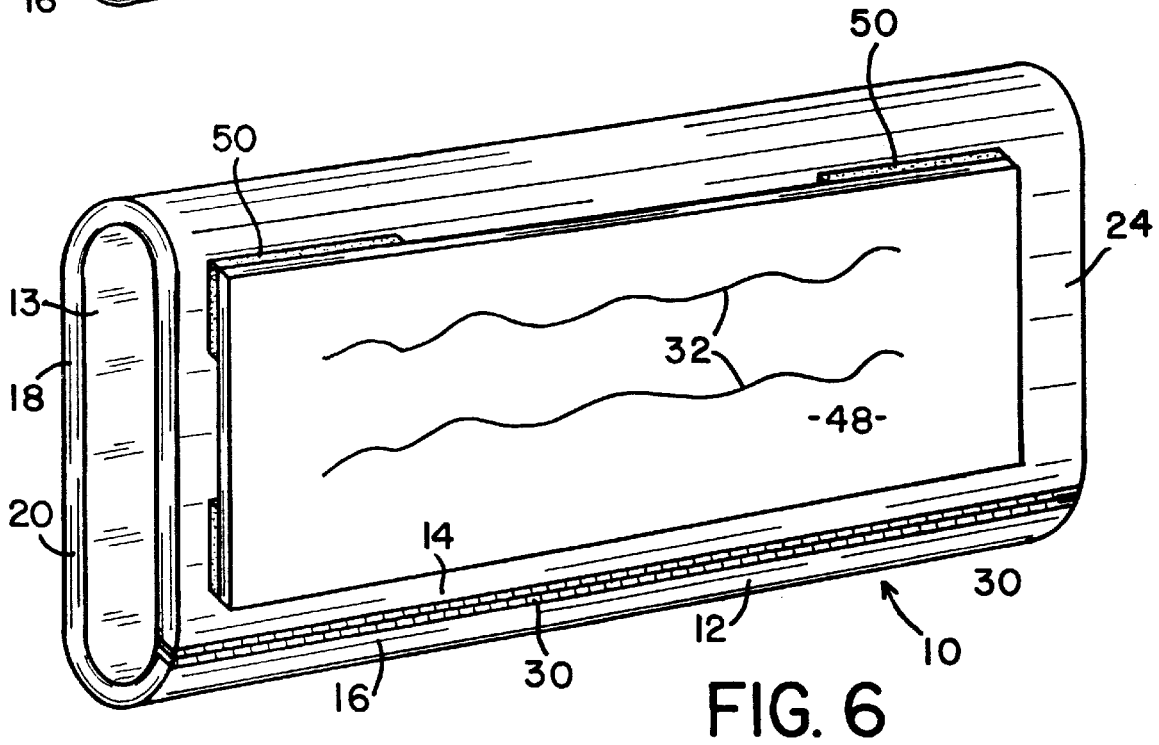
FIG. 6 is substantially a perspective view showing the embodiment above when in a second reversed position.

Another suitable attachment means is illustrated in FIGS. 3 & 4, wherein the attachment means for attaching the first end (14) to the second end (16) is by the first end (14) and the second end (16) being fixedly attached together with stitches (28). Still another suitable attachment means is illustrated in FIGS. 5 & 6, wherein the attachment means for attaching the first end (14) to the second end (16) is by the first end (14) and the second end (16) being fixedly attached together by a plastic zipper (30), or the like.

It is to be noted that when sleeve (12) is positioned over the tailgate it is important that the noted attachment means for attaching the first end (14) to the second end (16) is situated at a location which will not allow wind to interfere with the attachment means and cause the attachment means to accidentally disconnect. For example, as shown in the preferred embodiment and illustrated in FIGS. 1 & 2, when sleeve (12) is secured onto the tailgate, the attachment means will be substantially located within the interior of the truck bed, thus wind cannot interfere and disconnect the attachment means. This is very important, not only for function but also for increased safety. Thus the present invention will comply with highway patrol regulations, unlike the known prior art.

Referring now to FIGS. 1 & 2 wherein we show sleeve (12) having a front-side (22) which provides a first exterior surface having indicia (32) thereon, and a backside (24) which provides a second exterior surface, and front-side (22) is substantially opposed to back-side (24). It is to be understood that indicia (32) may be silk-screened, painted, embroidered, etc., onto either front-side (22), back-side (24) or both if desired. Thus, sleeve (12) may be reversible, or rotated between a first display position (see FIG. 1), and a second display position, (see FIG. 2).

In FIG. 3 we show another embodiment for sleeve (12) which includes the front-side (22) having a weather-proof transparent compartment (34) which is of a shape and size to slidably receive a first sign (36) therein, and first sign (36) having indicia (32) thereon. Also, sleeve (12) may include an optional weather-proof transparent pocket (38) for containment of an article of choice. Or still further if preferred, sleeve (12) may include compartment (34) and pocket (38) in combination, or multiples thereof depending on engineering choice.

It is to be noted that any suitable transparent compartment or pocket, of engineering choice may be used. However, it is contended by the applicants that such a compartment or pocket should be constructed with materials that are weather-proof, such as plastic, and the closure means should be reusable. For example, in FIG. 3 compartment (34) and pocket (38) are substantially constructed like a ZIP-LOCK BAGGY from plastic, having a zip-lock type closure, such as closure (40) or the like.

It is to be understood throughout the various views, indicia (32) can be substantially anything of user choice. For example in FIG. 3 first sign (36) includes indicia (32) thereon which is pertinent to a personal business, and pocket (38) is of a shape and size to contain business cards. Also, if preferred first sign (36) may be reversible having indicia (32) on two opposite sides. Thus the first sign (36) can be used to display two different messages of user choice.

It is to be noted that sleeve (12) if desired may be rotateable, or reversible between a first display position (see FIG. 3) and a second display position (see FIG. 4). Whereby as illustrated in FIG. 4, back-side (24) includes an optional weather-proof transparent display compartment (42) which is of a size and shape to slidably receive a second sign (44) therein, with second sign (44) having different indicia (32) thereon.

Further illustrated in FIGS. 3 & 4, sleeve (12) is made from previously noted materials, such as SPANDEX but each open end (18) and (20) may also include an elastic band (46) therein. Thus, sleeve (12) when installed on the tailgate, will conform and grasp the tailgate in a firm manner. Thus further providing a secure fit and this will also eliminate intrusion of wind, and allows sleeve (12) to be stretchable for a universal adjustable fit.

Furthermore, it is to be noted that sleeve (12) can be used to display only one sign (36) if desired, or multiple signs (36 & 44). Or still further although not shown, sleeve (12) can be turned inside-out. Whereby revealing and exposing a third exterior surface and a fourth exterior surface, each of which may be used for display purposes. Thus, if desired sleeve (12) can be used to display four different messages, depending on which exterior surface is to be used.

It is to be also understood that pocket (38) may be used to contain substantially anything of user choice, such as in FIG. 3, pocket (38) is used for display and removal of business cards. While in FIG. 4 pocket (38) is used to display flyers, or the like.

A third embodiment is disclosed in FIGS. 5 & 6, wherein sleeve (12) is again rotateable between a first display position (see FIG. 5) and a second display position (see FIG. 6) and sleeve (12) is substantially the same as previously described. However rather than having indicia (32) silk-screened onto sleeve (12), as taught within FIGS. (1 & 2), or having indicia on a sign (36) as taught within FIGS. (3 & 4), we now provide sleeve (12) with a removably attached sign (48). It is to be noted any suitable attachment means of engineering choice may be used for attaching sign (48) to sleeve (12). Such as we show sign (48) being removably attached onto sleeve (12) by at least one loop and pile fastener, such as VELCRO (50).

It is to be noted that any of the above described embodiments or components thereof, may be combined in any manner according to engineering choice, such as multiple pockets (38), multiple signs (36, 44, or 48), etc.

We also herein provide one example of a method for using a tailgate sign comprising of the following steps:

a. opening a tailgate (not shown) on a vehicle;

b. grasping a tailgate sign (arrow 10);

c. inserting a sign (36) of user choice into a compartment (34) on tailgate sign (arrow 10);

d. attaching the tailgate sign (arrow 10) onto the tailgate; and;

e. closing the tailgate.

It will now be seen we have herein provided a tailgate sign that is economical to manufacture and easy to use.

It will further be seen we have herein provided a tailgate sign which overcomes the many inherent disadvantages associated with the prior art.

It will also be seen we have herein provided a tailgate sign that is simple in construction, is reversible if so desired, is of a shape and size to be universal, allows for different signs to be used or multiples thereof, and complies with highway safety regulations, etc.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and wish to secure by LETTERS PATENT is:

1. In combination, a truck tailgate and a tailgate sign, the combination comprising:

a truck tailgate of generally rectangular shape;

a tailgate sign of generally rectangular shape and being sized to cover four sides of the truck tailgate;

the tailgate sign being made from a material that conforms to the truck tailgate;

the tailgate sign having first and second ends, a right side open end and a left side open end that defines the area of the tailgate sign rectangle;

the first and second ends having means for attaching the first and second ends together in overlapping relationship when the tailgate sign is in place covering the truck tailgate; and the tailgate sign also including a front-side and a back-side, the front-side including a first exterior surface and the back-side including a second exterior surface, indicia being placed on at least one of the first or second exterior surfaces.

2. The tailgate sign of claim 1 wherein said means for attaching the first and second ends together includes the first and second ends being adjustably held together with at least one loop and pile fastener.

3. The tailgate sign of claim 1 wherein said means for attaching the first and second ends together includes the first and second ends being fixedly held together with stitches.

4. The tailgate sign of claim 1 wherein each said open end includes an elastic band therein.

5. The tailgate sign of claim 1 wherein said back-side further includes indicia thereon, whereby if so desired the tailgate sign is rotateable between a first position and a second position.

6. The tailgate sign of claim 1 is made from a stretchable fabric, thus said tailgate sign conforms and grasps said tailgate when said tailgate sign is installed.

7. The tailgate sign of claim 1 further includes a weatherproof transparent pocket.

8. A method for using a tailgate sign comprising of the following steps:

a. opening a tailgate on a vehicle;

b. grasping a tailgate sign;

c. inserting a sign of user choice into a compartment on said tailgate sign;

d. attaching said tailgate sign onto said tailgate; and;

e. closing said tailgate.

* * * * *